US007802329B1

(12) United States Patent
Shrock et al.

(10) Patent No.: US 7,802,329 B1
(45) Date of Patent: Sep. 28, 2010

(54) FOLDING SEAT-BED FRAME

(75) Inventors: Scott J. Shrock, Granger, IN (US); Thomas W. Schrimsher, Sr., Elkhart, IN (US)

(73) Assignee: Shrock Manufacturing, Inc., Elkhart, IN (US)

( * ) Notice: Subject to any disclaimer, the term of this patent is extended or adjusted under 35 U.S.C. 154(b) by 15 days.

(21) Appl. No.: 12/255,704

(22) Filed: Oct. 22, 2008

(51) Int. Cl.
*A47C 17/38* (2006.01)

(52) U.S. Cl. ..... 5/142; 5/13; 5/37.1; 5/133; 5/149

(58) Field of Classification Search ..... 5/12.1, 5/13, 24, 37.1, 38, 43, 57.1, 133, 137, 142, 5/149

See application file for complete search history.

(56) References Cited

U.S. PATENT DOCUMENTS 463,221 A * 11/1891 Snyder ..... 5/142
564,465 A * 7/1896 Antisdel ..... 5/137
4,005,898 A * 2/1977 Way ..... 296/174
5,136,737 A * 8/1992 Reppas et al. ..... 5/2.1
5,280,656 A * 1/1994 Gossett ..... 5/2.1
5,528,778 A 6/1996 Shrock et al.
D388,632 S 1/1998 Kelley
6,163,900 A * 12/2000 Stevenson ..... 5/118

* cited by examiner

*Primary Examiner*—Robert G Santos
*Assistant Examiner*—Nicholas Polito
(74) *Attorney, Agent, or Firm*—Botkin & Hall, LLP

(57) ABSTRACT

A frame member supports a seat and a back and is movable between a horizontal position for supporting a user thereon and a vertical position for stowing the frame against the wall. Linkage secures the frame member to a wall mounting apparatus. The linkage includes oppositely disposed pairs of links that pivot the frame member relative to the wall to define a first distance between the wall and the frame member when the frame is in the vertical position and a second lesser distance between the wall and the frame member when the frame is in the horizontal position thus requiring less space between the frame and the wall. The frame assembly also has a leg pivotally connected to the frame member by linkage such that the leg moves beneath the frame between an upstanding supporting position and a collapsed storage position coincident with movement of the frame.

2 Claims, 5 Drawing Sheets

FOLDING SEAT-BED FRAME

BACKGROUND OF THE INVENTION

1. Field of the Invention

The invention relates to hideaway beds and seats and, more particularly, to a folding seat-bed frame for connecting to a wall so that the frame is movable between a generally horizontal position for supporting a user thereon and a generally vertical position for stowing the seat-bed along the surface of the wall when the seat-bed is in the bed position. The frame assembly moves toward the wall when it is lowered from its vertical position into the horizontal position.

2. Description of the Background of the Invention

Seat-beds are known. One such seat-bed is disclosed in U.S. Pat. No. 5,528,778. The seat-bed disclosed in the '778 patent includes a seat support and a back support carried by a frame. Linkage connects the seat and back supports to the frame in a manner so that the back can collapse and be coplanar with the seat to define a bed. Frames supporting these designs may be numerous, but none has been successfully incorporated into a hideaway bed design. Additionally, prior hideaway bed designs typically fold up and down from the wall in jack knife fashion, which often results in a waste of space. One such wall-bed is shown in U.S. Des. 388,632.

The reason these arrangements waste space is that the hinge assembly connecting the frame to the wall must be offset from the surface of the wall a sufficient distance for the hinge to operate. The pivot point of the hinge has to exceed a distance from the wall greater than the depth of the cushions carried by the frame. Otherwise, the end of the cushions nearest the hinge contact the wall and the bed cannot be folded upward and stowed in parallel along the wall's surface. This also limits the thickness and thus the comfort of the cushions that can be carried by the frame. In all prior designs, too much space between the wall and the edge of the bed frame is taken up and rendered useless by the hinge or hinge assembly. This is especially undesirable in campers and RVs where the lateral wall-to-wall distance as well as overall space is limited.

There therefore remains a need for an improved space-saving seat-bed frame. The present invention is directed toward meeting this need.

SUMMARY OF THE INVENTION

The invention relates to a seat-bed frame for connecting to a wall so that a seat-bed is movable between a generally horizontal position for supporting a user on it and a generally vertical position for stowing the seat-bed along the surface of the wall when the seat-bed is in a bed position. The frame includes a frame member for supporting the seat-bed, a wall mounting apparatus for securing the frame member to the wall, and linkage connecting the wall mounting apparatus and the frame member to define a first distance between the wall and the frame member when the seat-bed is in the vertical position and a second distance between the wall and the frame member when the seat-bed is in the horizontal position. The second distance is less than the first distance.

In one aspect of the invention, the linkage includes oppositely disposed pairs of links between the wall mounting apparatus and the frame member. Each pair of links includes an outside link that has one end pivotally attached to an outside surface of the wall mounting apparatus and its other end pivotally attached to an outside surface of the frame member and an inside link with one end pivotally attached to an inside surface of the wall mounting apparatus and its other end pivotally attached to an inside surface of the frame member. The links move such that the outside link is transverse to the wall to which the seat-bed is connected when the seat-bed is in the vertical position, and the inside link is parallel to the wall when the seat-bed is in the horizontal position.

In another aspect, a leg is pivotally connected to the frame member in a manner such that the leg moves between an upstanding supporting position and a collapsed stored position, respectively, when the frame member moves into the horizontal position and into the vertical position.

In still another aspect of the invention, the frame member is movable so as to define (i) a seat with a back or (ii) a bed.

One object of the invention is to provide an improved hideaway seat-bed frame that is drawn closer to the wall and thus saves space when folded down into its usable horizontal position. Related objects and advantages of the present invention will be apparent from the following description.

DETAILED DESCRIPTION OF INVENTION

Figure 1:
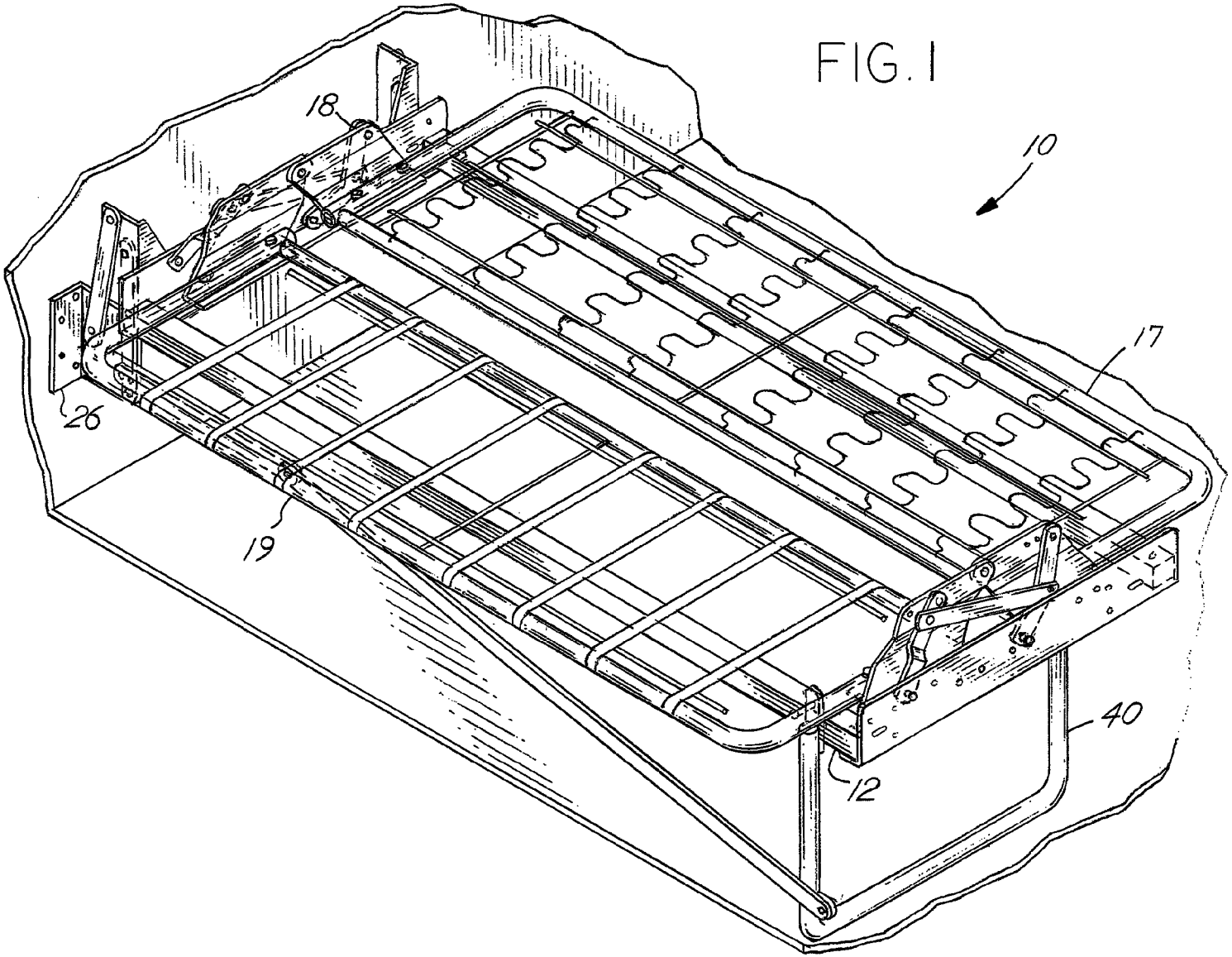
FIG. 1 is an isometric view showing the seat-bed frame member of the invention in the horizontal position with the back folded down to form a bed.
Figure 2:
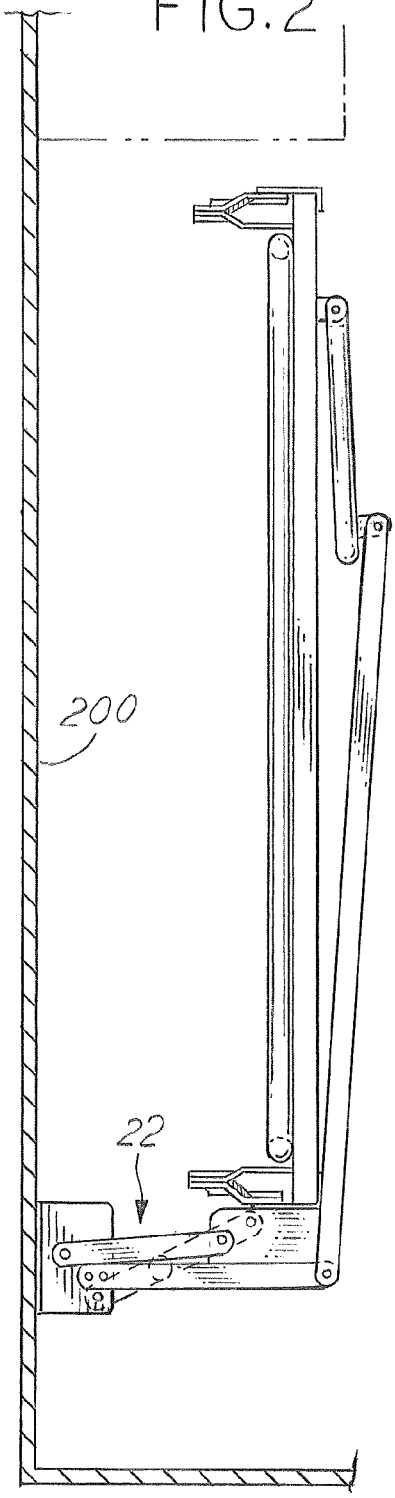
FIG. 2 is a side elevational view of the frame member in the vertical stowed position showing the leg in its stored position.
Figure 3:
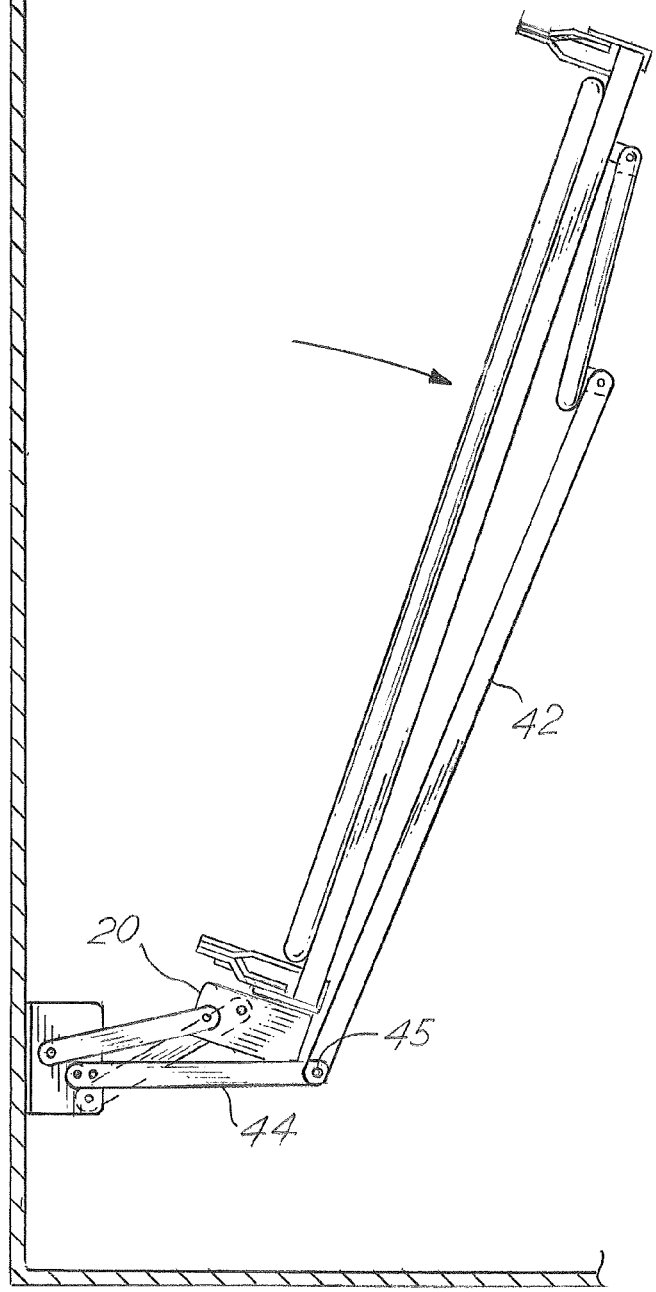
FIG. 3 is a side elevational view of the frame member of FIG. 1 in an interim position between the vertical position and the horizontal position.
Figure 4:
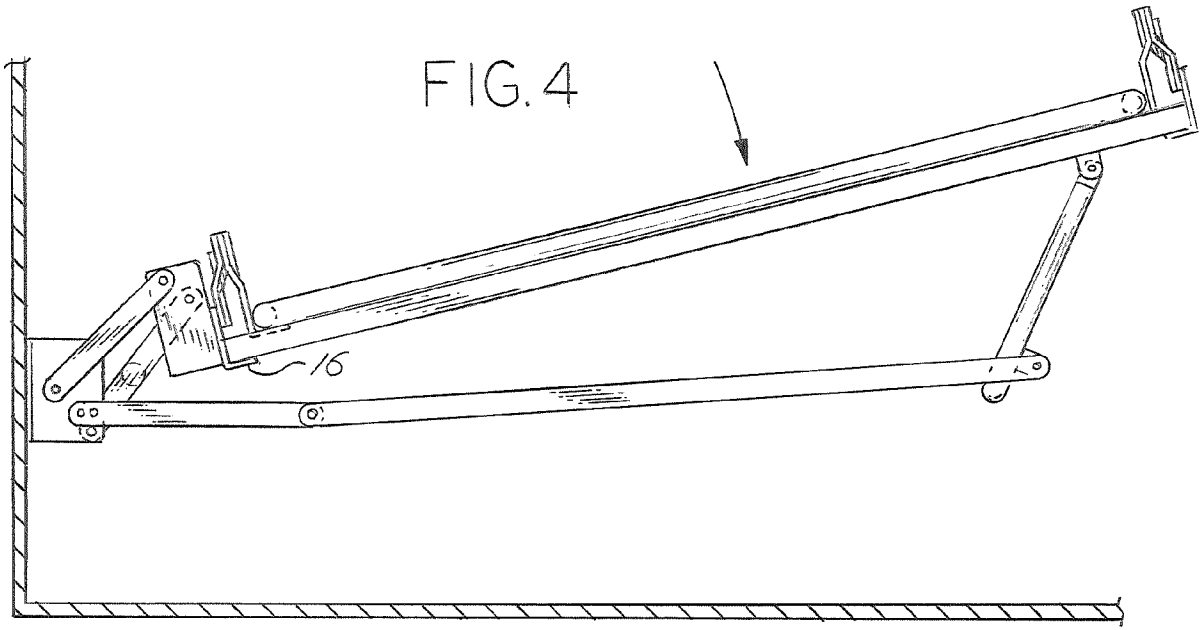
FIG. 4 is another side elevational view of the frame member of FIG. 1 showing the leg in an interim position between its supporting position and the leg's stored position.
Figure 5:
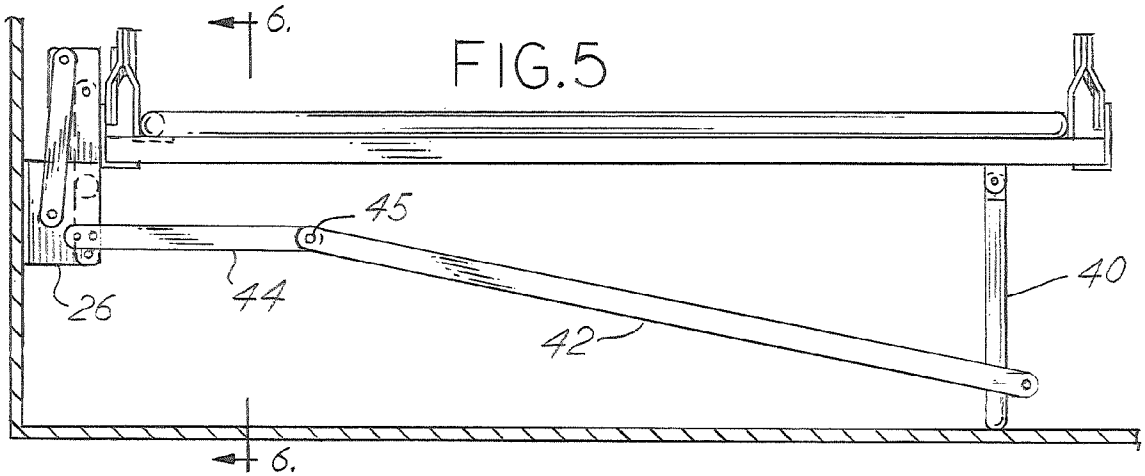
FIG. 5 is yet another side elevational view of the frame member of FIG. 1 shown in the horizontal position with the leg in its supporting position.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Figure 6:
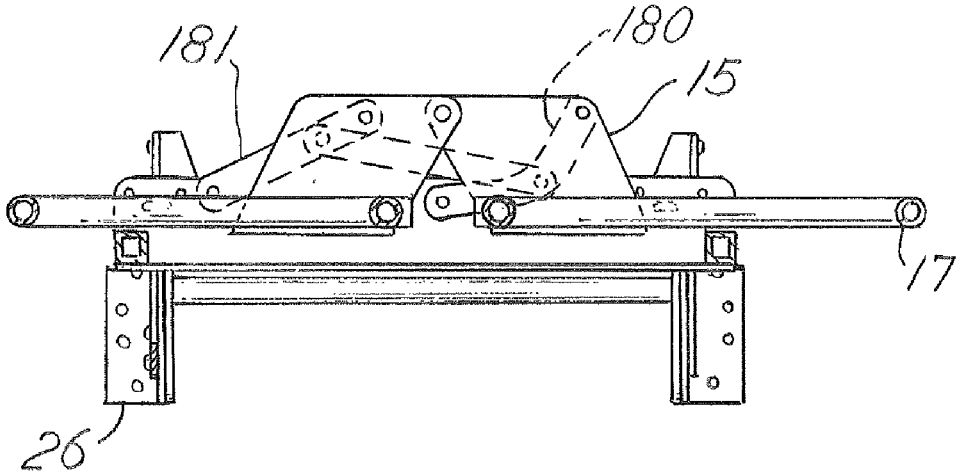
FIG. 6 is a cross-sectional view of the frame member taken along lines 6-6 of FIG. 5 showing the linkage assembly for moving the seat back to define a bed.
Figure 7:
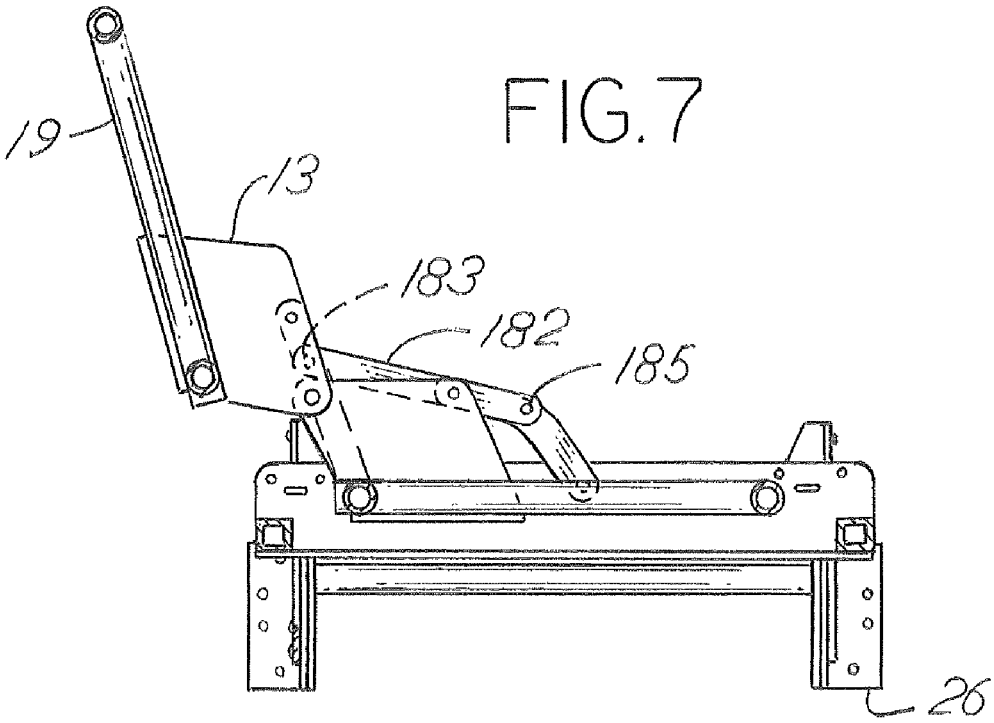
FIG. 7 is a view like the one shown in FIG. 6 illustrating the seat back in its upward position.

A space-saving seat-bed frame 10 for connecting to a wall is illustrated in the figures. The frame 10 includes a rigid frame member 12 that carries a seat 17 and a back 19. The frame 10 is formed from a rigid material such as metal or plastic, preferably steel. Cushioning (not shown) of a type suitable for such furniture is preferably attached by known means to the seat 17 and back 19. A seat plate 15 is fastened at each end of the seat, and a back plate 13 is secured to both ends of the back 19. The plates 13, 15 are secured, respectively, at one of their ends to the back 19 and the seat 17 and joined at their other ends by a seat/back linkage assembly 18 also located at each end 16 of the frame member 12. The seat/back linkage is best illustrated in FIGS. 6 and 7.

Each of the assemblies 18 pivotally connects a corresponding plate to the ends 16 of the frame member, which enables the back 19 to fold down so the back is flush with the seat 17 to define a bed, as shown in FIG. 1. With reference to FIGS. 6 and 7, each seat/back linkage assembly 18 includes a seat link 180, a back link 181, and a connecting link 182, which links 180, 181, 182 are similar to the linkage disclosed in U.S. Ser. No. 11/758,742, the disclosure of which is hereby incorporated by reference. Seat link 180 is pivotally connected at one end to the seat plate 15 and its other end to the end 16 of frame member 12. Back link 181 is pivotally connected at one end to the back plate 13 and its other end to the end 16 of frame member 12. Connecting link 182 pivotally connects the seat link 180 and the back link 181 at pivot points 183 and 185, which are located generally near the mid portions of links 180, 181.

In one embodiment, a wall mounting apparatus includes a wall mount 26, which connects one end 16 of the frame assembly 10 to the wall 200. Wall mount 26 has an outside face 27 and an inside face 29. Two spaced wall mounts 26 may be secured to the wall using known means such as machine screws, bolts and nuts, wood screws or the like. Connection plates 20 are secured to the end 16 of the frame member 12 using known means. Each connection plate 20 has an interior surface 9 and an exterior surface 7.

Figure 8:
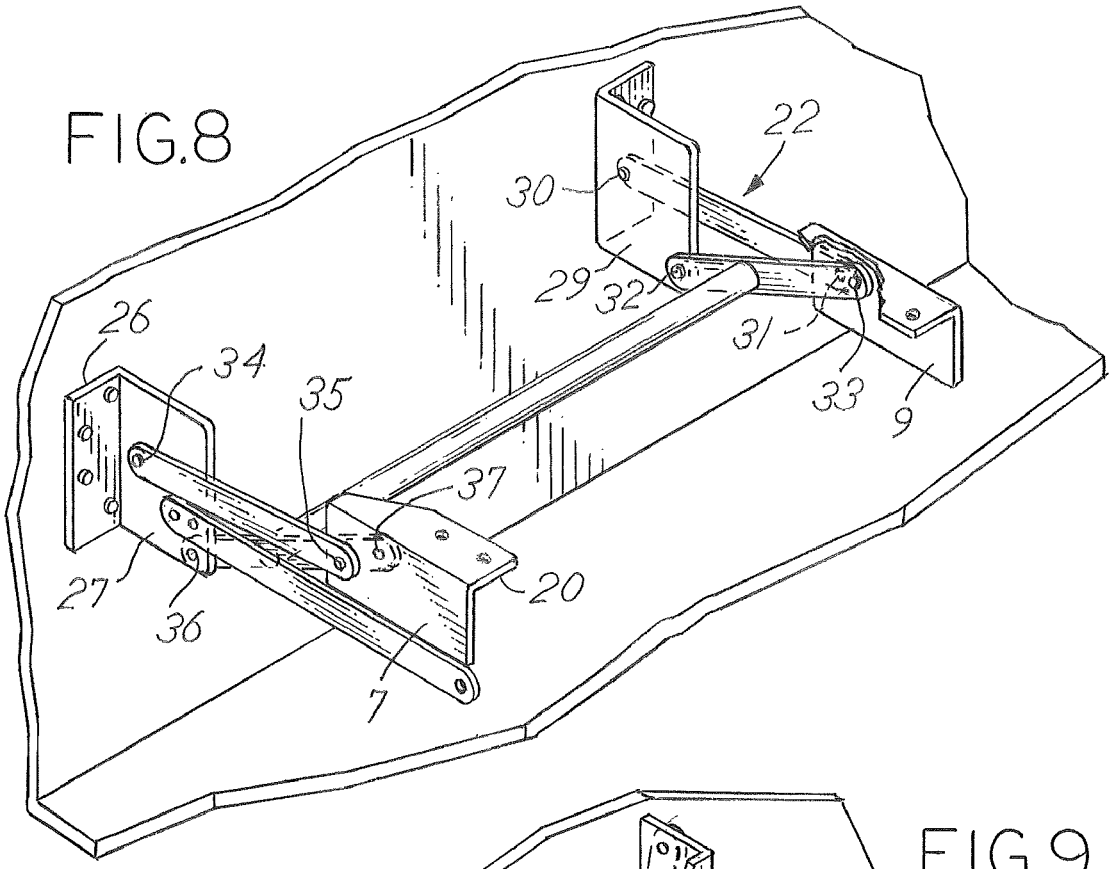
FIG. 8 is a fragmented perspective view of the frame member with the seat and back, seat/back linkage and other items removed to highlight the oppositely disposed pairs of links when the frame member is in the vertical position.
Figure 9:
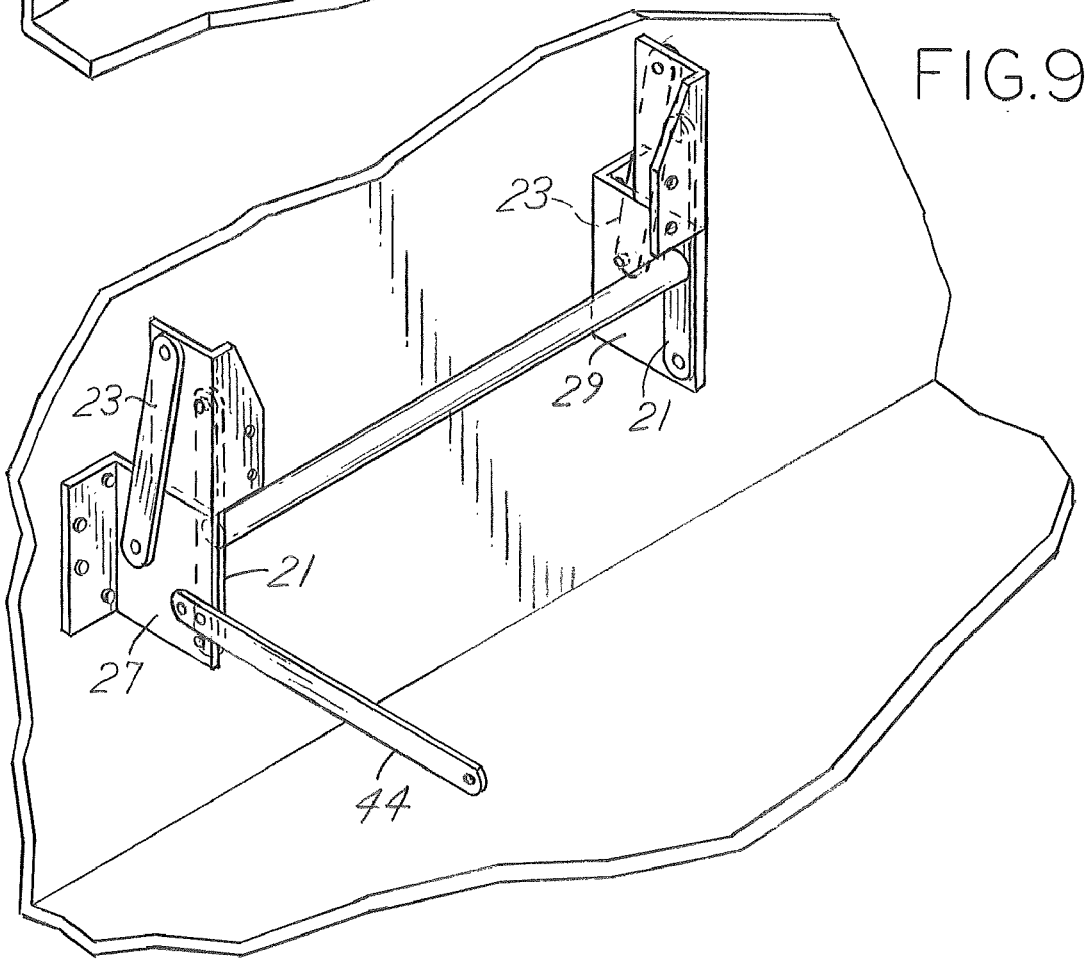
FIG. 9 is a fragmented perspective view like the one of FIG. 8 to show the oppositely disposed pairs of links when the frame member is in the horizontal position.

FIGS. 8 and 9 show the movement of linkage that connects the frame 10 to the wall 200 when the frame moves between the vertical (FIG. 8) and horizontal (FIG. 9) positions. A pair of links 22 located on each of the sides of the front end 16 of the seat-bed frame pivotally connect the frame to wall mounts 26 at pivot points 30, 32, 34, 36 and the connection plates 20 at pivot points 31, 33, 35, 37. Each pair of links includes an inside link 21 and an outside link 23. The inside link 21 is pivotally connected to and positioned against the inside face 29 of a wall mount 26 and the interior surface 9 of a connection plate 20; and the outside link 23 is connected to and positioned against the outside face 27 of a wall mount 26 and the exterior surface 7 of a connection plate 20. Referring to FIGS. 2-5 and 8-9, when the frame member 12 is moved between its vertical and horizontal positions, respectively, the links are capable of moving such that outside link 23 is generally transverse to a plane defined by the surface of the wall 200 to which the seat-bed is connected when the seat-bed is in the vertical position (FIGS. 2 and 8), and the inside link 21 is parallel to the wall when the seat-bed is in the horizontal position, as shown in FIGS. 1, 5-7, and 9. The frame member 12 is moved by hand.

Additionally, a leg 40 is pivotally connected to the frame member to add support strength while the frame is in the horizontal position. A mounting link 44 and a leg link 42 connected at pivot 45 connect the leg 40 and the wall mount 26 so that the leg 40 moves between an upstanding supporting position and a collapsed stored position, respectively, upon movement of the frame member 12 from the horizontal position into the vertical position. The leg 40 moves as described in response to the movement of the frame 10, and the leg may be connected directly to the wall 200 in the absence of a wall mount 26. The user does not have to move the frame 10 and then, in a second effort, grasp and move the leg 40 from the supporting position to the collapsed position. As a result of links 42, 44, movement of the leg 40 is coincident with movement of the frame member 12 between the horizontal and vertical positions.

The pairs of links 22 cause the frame to move toward the wall 100 a distance, of between six and ten inches (6-10 inches) when the frame member 12 moves from the vertical storing position into the horizontal useful position thus making available additional space heretofore occupied by prior fold down seats/beds. Accordingly, two seat-bed frames may be positioned along the same wall opposite each other with a table there between to define a dinette in a recreational vehicle, for example.

The frame, plates, seat, back, and linkages should be formed from a rigid, sufficiently strong material such as metal, metal alloy or plastic, preferably steel.

While the invention has been illustrated and described in detail in the drawings and foregoing description, the same is to be considered illustrative and not restrictive in character. It is understood that the embodiments have been shown and described in the foregoing specification in satisfaction of the best mode and enablement requirements. It is understood that one of ordinary skill in the art could readily make a nearly infinite number of insubstantial changes and modifications to the above-described embodiments and that it would be impractical to attempt to describe all such embodiment variations in the present specification. Thus, it is understood that it is desirable to protect all the changes in modifications that come within the spirit of the invention.

What is claimed is:

1. A seat-bed frame for connecting to a wall so that a seat-bed is movable between a generally horizontal position for supporting a user thereon and a generally vertical position for stowing said seat-bed along the surface of the wall when the seat-bed defines a bed, said frame comprising:

a frame member for supporting said seat-bed;

a wall mounting apparatus for securing said frame member to the wall; and linkage connecting said wall mounting apparatus and said frame member to define a first distance between said wall and said frame member when said seat-bed is in said vertical position and a second distance between said wall and said frame member when said seat-bed is in said horizontal position, said second distance being less than said first distance, said linkage including oppositely disposed pairs of links between said wall mounting apparatus and said frame member, each pair of links including an outside link with one end pivotally attached to an outside surface of the wall mounting apparatus and its other end pivotally attached to an outside surface of the frame member, and an inside link with one end pivotally attached to an inside surface of the wall mounting apparatus and its other end pivotally attached to an inside surface of the frame member, wherein the links move such that said outside link is transverse to the wall to which the seat-bed is connected when said seat-bed is in said vertical position, said inside link is parallel to the wall when the seat-bed is in said horizontal position.

2. A frame assembly according to claim 1, wherein said frame member is movable so as to define (i) a seat with a back or (ii) a bed.

* * * * *